United States Patent [19]

Berndt, Jr.

[11] 4,406,088

[45] Sep. 27, 1983

[54] DOOR BOTTOM SEALING APPARATUS

[76] Inventor: Fred P. Berndt, Jr., 1575 Edgewater Ave., Arden Hills, Minn. 55112

[21] Appl. No.: 319,231

[22] Filed: Nov. 9, 1981

[51] Int. Cl.[3] ..... E06B 7/20

[52] U.S. Cl. ..... 49/309; 49/310

[58] Field of Search ..... 49/309-314, 49/399, 400, 504, 480, 481

[56] References Cited

U.S. PATENT DOCUMENTS

| | | | |
|---|---|---|---|
| 1,853,338 | 4/1932 | Dennis | 49/309 |
| 3,030,674 | 4/1962 | Kapaun et al. | 49/309 |
| 3,250,314 | 5/1966 | Wetzel | 49/309 X |

*Primary Examiner*—Kenneth Downey
*Attorney, Agent, or Firm*—Leo Gregory

[57] ABSTRACT

A door bottom weather sealing structure carried as a surface mounting at the inside bottom portion of a door comprising a channel member extending the width of a door having disposed therein an extensible and retractable sealing member, the sealing member having an outward projection thereof engaging the door jamb upon the closing of the door for an automatic extension of the sealing member into floor engagement and an automatic retraction of the sealing member upon the opening of the door, the structure providing a precise adjustment of the extension of the sealing member.

5 Claims, 7 Drawing Figures

DOOR BOTTOM SEALING APPARATUS

BACKGROUND OF THE INVENTION

1. Field of Invention.

This invention relates to a self-operated door bottom sealing structure.

2. Description of the Prior Art.

Extensible door bottom sealing structures are known in the art and are generally operated by a projecting rod engaging a door jamb upon the closing of the door to extend the sealing member into floor engagement. Such a structure may be fitted into a channel formed within a door bottom or may comprise a channel member which is mounted upon the surface of the bottom edge portion of a door.

The sealing member is extended upon engagement of the door jamb with a projecting rod, said rod being moved axially to cause the downward extension as of a plate spring member which causes the sealing member to extend below the door bottom and into floor engagement. The extending member generally engages a small portion of the length of the extending member and with a door which may have a width of four to five feet, there is not a uniform and even projection of the sealing member. It may engage the floor in part and it may leave sufficient space for the leakage of air depending upon the level of the floor.

It is desirable to have a door sealing member which is precisely adjustable its full length for floor sealing engagement.

SUMMARY OF THE INVENTION

This invention relates to a door bottom weather sealing structure which is self-operating upon the closing of a door and which is precisely adjustably positioned its full length for floor sealing engagement.

It is an object of this invention to provide a door bottom weather sealing structure comprising a channel member surface mounted upon the inner side bottom edge portion of a door, said channel member having disposed therein an extensible floor engaging sealing member which is self-operable upon the closing of a door and means spaced lengthwise of said channel member causing said sealing member to project uniformly its full length.

More specifically it is an object of this invention to provide a door bottom weather sealing structure comprising a housing member having disposed therein a suspension member and extensibly connected therewith a sealing member, torsion springs connecting said suspension member and said sealing member and normally drawing said sealing member into a retracted position and a plurality of adjusting screws connecting said first housing and said suspension member, said adjusting screws vertically spacing said second suspension member uniformly for the full length thereof to cause a precise floor sealing engagement of said sealing member.

DESCRIPTION OF A PREFERRED EMBODIMENT

Figure 1:
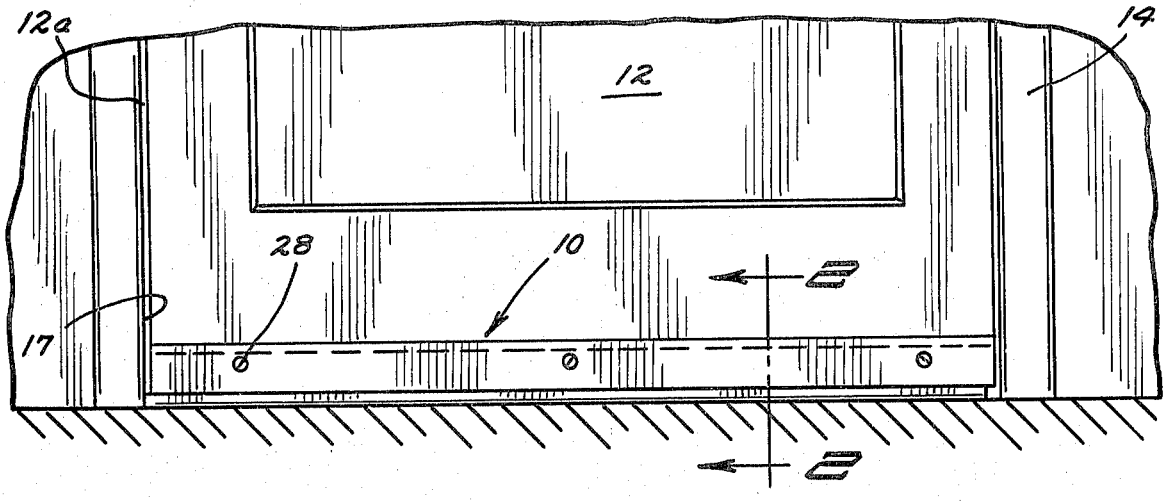
FIG. 1 is a broken view showing the apparatus herein in side elevation.
Figure 2:
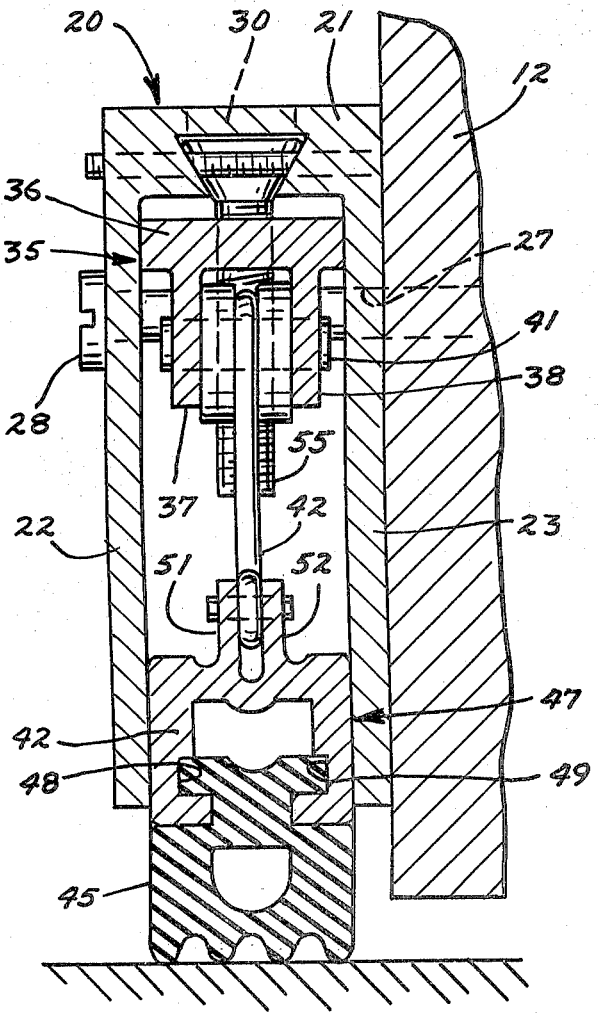
FIG. 2 is a broken view on an enlarged scale in vertical cross section taken on line 2—2 of FIG. 1 as indicated.
Figure 3:
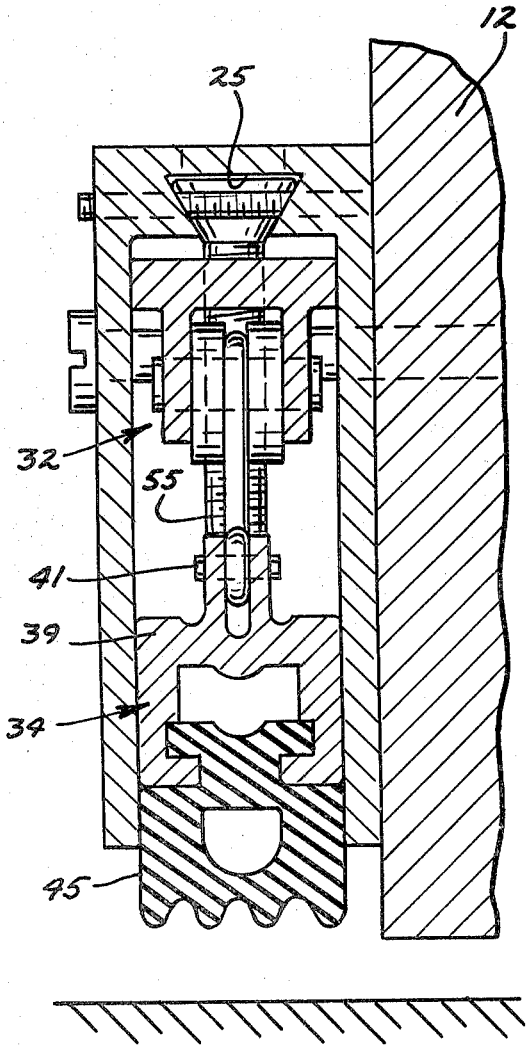
FIG. 3 is a view similar to that of FIG. 2 showing an alternate position.
Figure 4:
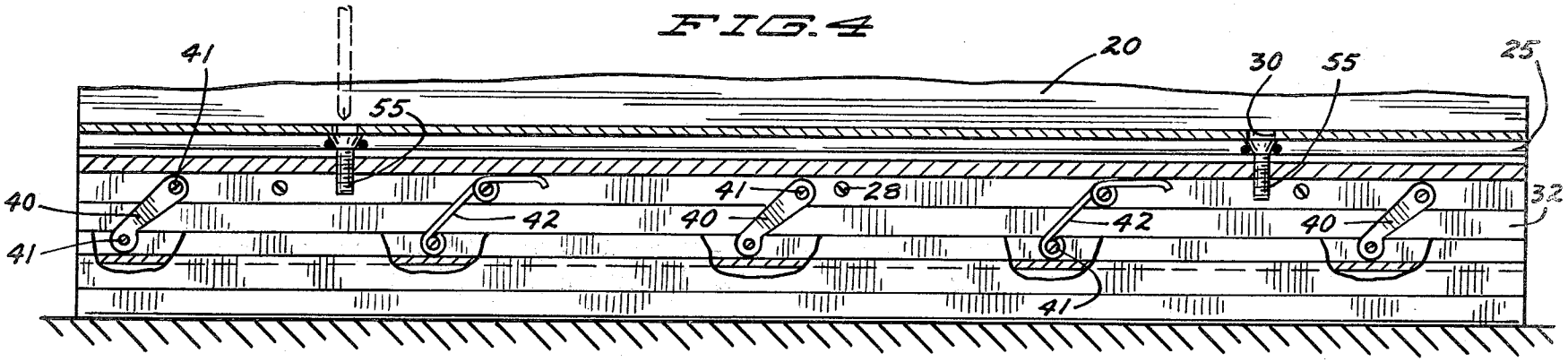
FIG. 4 is a view in longitudinal vertical cross section showing an extended position of the sealing member.
Figure 5:
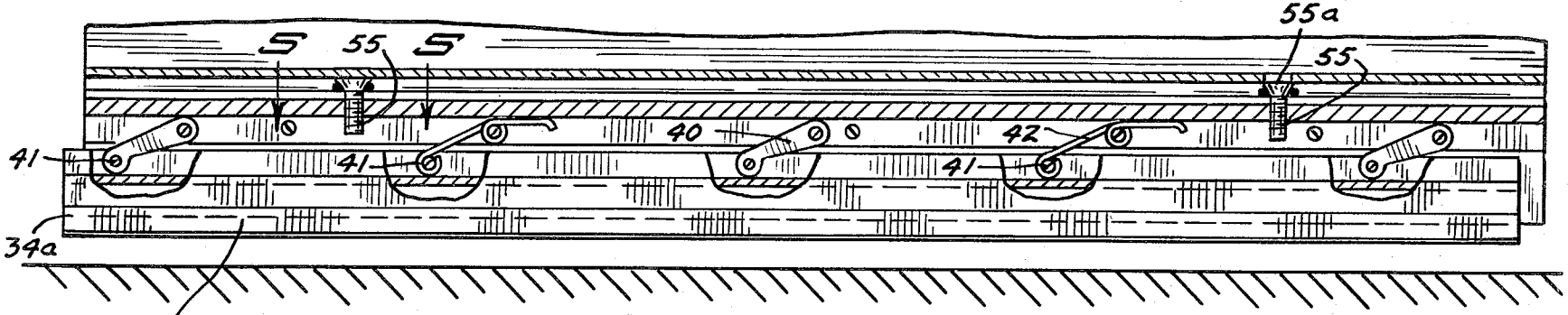
FIG. 5 is a view similar to FIG. 4 showing the device in a retracted position.
Figure 7:
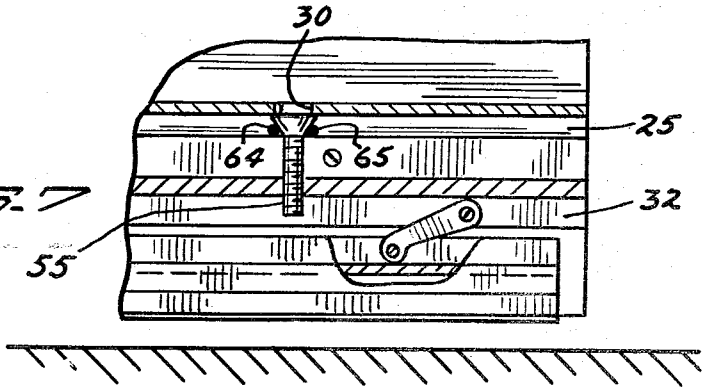
FIG. 7 is a broken view in vertical section showing an alternate adjusted position.
Figure 6:
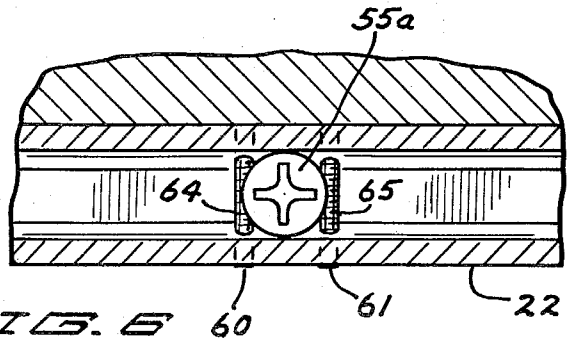
FIG. 6 is a broken view in horizontal section showing a detail of structure.

Referring to the drawings, the structure comprising the invention herein is indicated generally by the reference numeral 10.

In FIG. 1, the apparatus is shown in operating position surface mounted onto the inner side bottom edge portion of a door 12, said door being mounted in a door frame 14 having a jamb or jamb strip 17 adjacent the inner edge portion 12*a* of said door.

Referring to FIGS. 2–6, said door sealing apparatus 10 comprises a housing 20 formed as an inverted U-shaped channel member having a top wall 21 and spaced side walls 22 and 23.

Formed into the inner side of said top wall 21 and extending the length thereof is an open bottom V-shaped slot or groove 25. Extending transversely through said housing are spaced apertures 27 to receive therethrough mounting screws 28.

Said top wall has a plurality of vertically disposed holes 30 therethrough for a purpose to be described.

Carried within said channel member 20 is a door bottom sealing structure consisting of members 32 and 34.

The member 32 forms a suspension member comprising a channel 35 having a top wall 36 and having laterally inset spaced side walls 37 and 38. Pivotally secured by rivet pins 41 between said walls 37 and 38 at longitudinally spaced intervals are arms or hangers 40. Longitudinally spaced between said hangers and secured between said walls by rivet pins 41 are torsion springs 42 which will be mounted and secured in a conventional manner.

The member 34 comprises a sealing element and is shown formed as a channel member 47 having therein a pair of opposed facing grooves 48 and 49 to secure a suitable sealing strip 45 therebetween which depends therefrom. Said channel member has upwardly extending closely spaced side walls 51 and 52 adapted to receive and have pivotally secured therebetween the lower portions of said hangers 40 as by rivet pins 41. Said torsion springs have their lower portions disposed between said walls spaced between pairs of said hangers, the same being secured by rivet pins 41.

Said member 34 is normally held in an inoperative offset position by said torsion springs, the member 34 being offset somewhat relative to the member 32 as to have a projecting portion 34*a* adjacent the door jamb whereby, as will be described, when the door is closed, said projection 34*a* is caused to move inwardly of the housing member 20 and contra to said torsion spring and thus causing the sealing member 34 to project downwardly outwardly of said housing member 20 into a floor sealing engagement. The suspension member 32 remains stationary.

The salient novelty herein is present in the structure which causes a precise or controlled downward projection of the sealing member 34. The torsion springs and hangers fully extended cause the member 34 to project uniformly. If an underlying floor surface is other than parallel to the door bottom, there will not be a full extension or a full length positive seal engagement with the floor as the high point of the engaged floor surface will control the extent to which the sealing member projects outwardly of the housing member for floor engagement.

The member 32 has a plurality of apertures 33 therein. These apertures are tapped to receive adjustment screws 55 therein and these will be suitably spaced longitudinally of said top wall aligned with said holes 30. Two screws are shown here for purpose of illustration. The screw heads 55*a* are disposed within said groove 25. The top wall 21 of the channel member 20 thus has said holes 30 therein for access to said screw heads 55*a*. Said side wall 22 is tapped as at 60 and 61 at each side of the screw head 55*a* and received therein are screws 64 and 65 to make captive said screw head.

By rotating the screw 55, the member 32 may be lowered or raised relative to said housing member 20. There is thus a precise longitudinal depth control of the extent that the sealing member 45 is projected outwardly of the housing member 20. The sealing member thus may be retained in a very controlled position. The sealing member may be projected horizontally or at a slant by adjustment of the screws to correspond to the elevation of the floor and more or less floor engaging pressure may be attained by adjustment of said screws 55.

The sealing structure herein has been found to be very effective and particularly so with doors of substantial width.

It will of course be undestood that various changes may be made in form, details, arrangement and proportions of the parts without departing from the scope of the invention herein which, generally stated, consists in an apparatus capable of carrying out the objects above set forth, in the parts and combinations of parts disclosed and defined in the appended claims.

What is claimed is:

1. A door bottom weather sealing structure having in combination a housing member, a suspension member adjustably disposed within said housing member, a sealing member co-extensive with said suspension member, means operatively connecting said suspension member and said sealing member, said sealing member being offset normally longitudinally of said suspension member by said means and having an end portion thereof projecting outwardly of said housing member, means carried by said housing member adjustably positioning said suspension member within said housing member vertically thereof, said housing member having an open bottom V-groove formed on the inner side of the top wall thereof, said last mentioned means comprising screws having their respective heads disposed within said groove, and said screws adjusting the position of said suspension member relative to said top wall of said housing.

2. The structure of claim 1, including means removably disposed through the side walls of said housing member making captive said heads of said screws within said groove of said housing.

3. A door bottom weather sealing structure, having in combination a housing member comprising a door mounting means, an inverted U-channel member disposed within said first housing member, a sealing member co-extensive with said channel member, means operatively connecting said second channel member and said sealing member extending and retracting said sealing member relative to said housing member, said sealing member being disposed longitudinally of said channel member having a projection thereof extending longitudinally outwardly of said housing member, a plurality of adjustable means mounting said channel member within said first housing member, said adjustable means positioning said channel member for a corresponding extension of said sealing member into floor sealing engagement, said housing member comprising an inverted U-channel member and having a top wall therein, said top wall having an open bottom V-groove formed on the inner side portion thereof, a plurality of screws upstanding from the top wall of said first mentioned channel member, said screws having their head portions disposed within said groove, said housing member having apertures in its top wall providing access to said screws, whereby said screws are rotatable for vertical adjustment of said channel member relative to said housing member.

4. The structure set forth in claim 3, including means removably disposed at each side of said screw heads securing the same against lateral movement.

5. A door bottom weather sealing structure, having in combination a housing member comprising a door mounting means, an inverted U-channel member disposed within said first housing member, a sealing member co-extensive with said channel member, means operatively connecting said second channel member and said sealing member extending and retracting said sealing member relative to said housing member, said sealing member being disposed longitudinally of said channel member having a projection thereof extending longitudinally outwardly of said housing member, a plurality of adjustable means mounting said channel member within said first housing member, said adjustable means positioning said channel member for a corresponding extension of said sealing member into floor sealing engagement, said housing member comprising an inverted U-channel member and having a top therein, said top wall having an open bottom V-groove formed on the inner side portion thereof, a plurality of screws upstanding from the top wall of said first mentioned channel member, said screws having their head portions disposed within said groove, said housing member having apertures in its top wall providing access to said screws, whereby said screws are rotatable for vertical adjustment of said channel member relative to said housing member, said adjustable means comprising screws, a slot on the inner side of the top wall of said first channel member receiving the heads of said screws, a plurality of openings in the top wall of said first channel member providing access to the heads of said screws, and whereby rotation of said screws vertically adjusts said sealing member relative to said first channel member.

* * * * *